US005333861A

United States Patent [19]

Mills

[11] Patent Number: 5,333,861

[45] Date of Patent: Aug. 2, 1994

[54] GOLF CLUB

[76] Inventor: Peter B. Mills, 505 Greenlaurel Dr., Atlanta, Ga. 30342

[21] Appl. No.: 61,681

[22] Filed: May 14, 1993

[51] Int. Cl.[5] ..... A63B 53/04

[52] U.S. Cl. ..... 273/78; 273/173; 273/DIG. 22; 273/DIG. 8

[58] Field of Search ..... 273/167 R-77 A, 273/78, DIG. 8, DIG. 22, 77 R

[56] References Cited

U.S. PATENT DOCUMENTS

| | | | |
|---|---|---|---|
| 1,361,258 | 12/1920 | Horton | 273/173 |
| 3,211,455 | 10/1965 | Hyden | 273/173 X |
| 3,937,474 | 2/1976 | Jepson | 273/DIG. 8 X |
| 4,156,526 | 5/1979 | Huggins | 273/78 |
| 4,193,601 | 3/1980 | Reid | 273/167 R |
| 4,445,688 | 5/1984 | Frillici | 273/DIG. 22 X |
| 4,968,038 | 11/1990 | Yamada | 273/DIG. 22 X |
| 5,083,778 | 1/1992 | Douglass | 273/78 |
| 5,246,227 | 9/1993 | Sun | 273/173 X |

FOREIGN PATENT DOCUMENTS

| | | | |
|---|---|---|---|
| 23391 | of 1894 | United Kingdom | 273/167 F |
| 4631 | of 1900 | United Kingdom | 273/167 G |
| 8789 | of 1900 | United Kingdom | 273/78 |
| 15069 | of 1903 | United Kingdom | 273/78 |
| 2124911 | 2/1984 | United Kingdom | 273/173 |

*Primary Examiner*—Theatrice Brown
*Assistant Examiner*—Sebastiano Passaniti
*Attorney, Agent, or Firm*—Hopkins & Thomas

[57] ABSTRACT

A head of a golf club has a central leather panel the surface of which forms a striking surface for engaging a golf ball. A flexible plastic layer adhered to the striking surface yields with the leather when the golf ball is struck. This construction enables more accurate control of the ball.

7 Claims, 1 Drawing Sheet

GOLF CLUB

BACKGROUND OF THE INVENTION

1. Field of the Invention

This invention relates to golf clubs and is more particularly concerned with putters.

2. Description of the Prior Art

In the past, golf club have usually contained faces which are made of metal, or wood, or a combination thereof. Since metal is quite rigid, a ball struck with a metal club is difficult to control since only a small tangential portion of the spherical surface of the ball is engaged by the face of the golf club as it is struck. Even those clubs, which have wooden faces engage only a very small tangential portion of the ball when the ball is struck. This is particularly true when putting since the velocity of the golf club (putter) when it strikes the ball is relatively low. The present invention tends to overcome the difficulty described above in that a yieldable striking surface is provided, which enables the player to control the ball more accurately.

SUMMARY OF THE INVENTION

Briefly described, the present invention includes a conventional golf club which is provided with a leather central insert or panel received in an outwardly opening recess in the face of the club, so that the outer surface of the panel forms the striking surface for engaging the golf ball. A plastic coating over the outer surface provides the striking surface with a protective outer layer which is resilient. This combination of leather and plastic layers enhances the player's control of the golf ball. These characteristics are particularly useful when the golf club is a putter.

Accordingly, it is the object of the present invention to provide a golf club which enhances the control of the golf ball by the player.

Another object of the present invention is to provide a golf club, the striking surface of which is relatively soft so that it will yield to thereby engage a substantial portion of the tangential surface of the ball being struck.

Another object of the present invention is to provide a golf club which, when used to strike a ball, will provide the player with a better feel or touch as the ball is struck.

Another object of the present invention is to provide a golf club having a face provided with a striking zone which is yieldable whereby the head of the golf club will remain in engagement with the ball for a slightly greater length of time, thereby facilitating improved control of the ball.

Another object of the present invention is to provide a golf club which will reduce the sound of the club as it strikes the ball and thus tend not to interfere with the thought processes of the player.

Another object of the present invention is to provide a golf club which will enhance the ability of a player to control the roll, the trajectory and the velocity of the golf ball which is struck by the club.

Other objects, features and advantages of the present invention will become apparent from the following detailed description when combined in conjunction with the accompanying drawings wherein like characters of reference designate corresponding parts throughout the several views.

DETAILED DESCRIPTION

Figure 1:
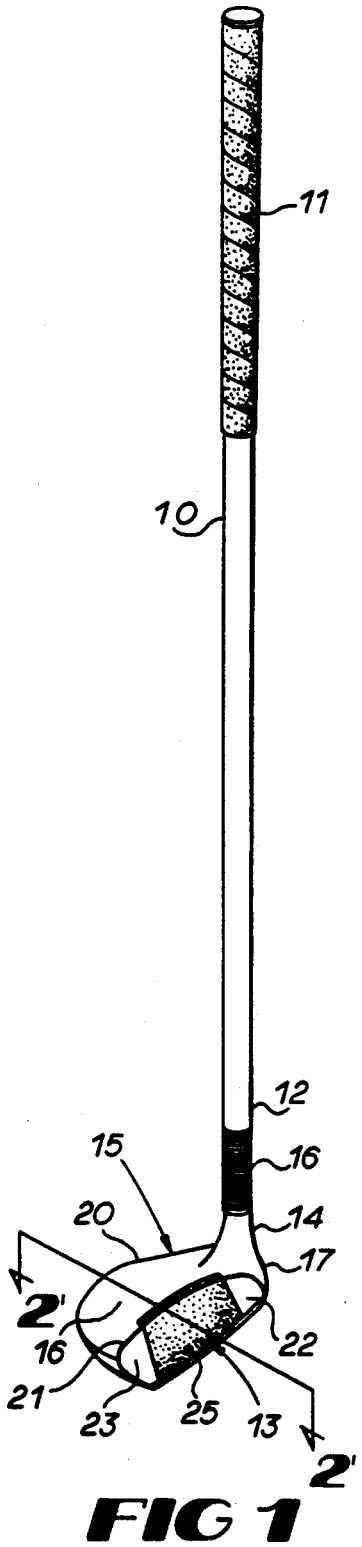
FIG. 1 is a perspective view of a golf club constructed in accordance with the present invention.
Figure 3:
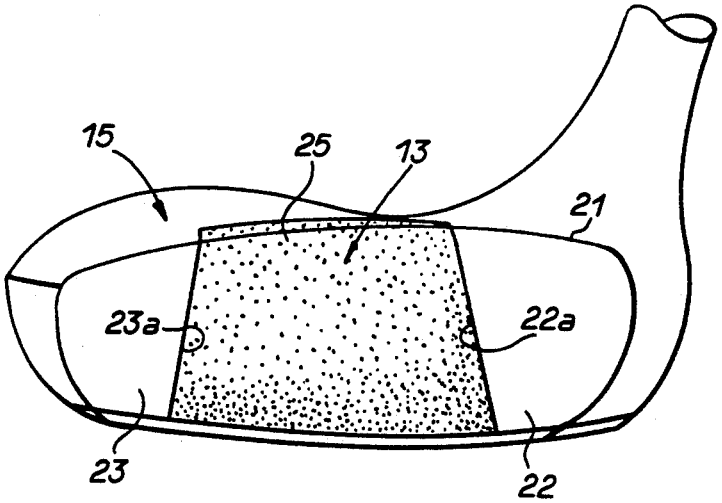
FIG. 3 is an enlarged front elevational view of the head portion of the golf club shown in FIG. 1.
Figure 2:
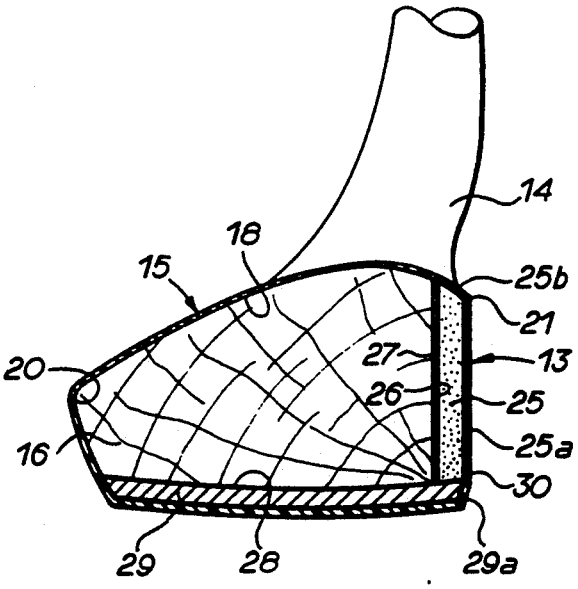
FIG. 2 is an enlarged cross-sectional view taken substantially along line 2—2 in FIG. 1.

Referring now in detail to the preferred embodiment of the present invention, as disclosed in the drawings, numeral 10, in FIG. 1, 2 and 3, denotes the shaft of my golf club which as illustrated is a putter. This shaft 10 is formed of metal, plastic or wood. It has the usual handle or grip 11 at its upper or proximal end portion and carries a club head 15 at distal end 12. The distal end 12 of shaft 10 protrudes into and is fixed in the usual way in the hosel in the neck 14 of the club head 15. Wrapping 16 extends around the upper portion of the neck 12 and a part of the distal end portion 12 of shaft 10.

The club head 15 has a body 16, preferably formed of wood having, as an integral part thereto, the neck 12 which extends upwardly from the narrow rounded heel 17 of body 16.

The upper surface 18 of the body 16 is convexed as viewed in FIG. 2, and extends from the arcuate concaved rear or trailing edge 20 of body 16 of to the top front edge 21. The front edge 21 forms a common arcuate edge between the upper surface 18 and the vertically disposed face 13. This face 13 includes an inner face segment 22 and a outer face segment 23 which are disposed in a common vertical plane and separated by a central recess.

The body 16 is wider in its central portion and has a rounded toe portion and also a generally flat or slightly concaved bottom surface 28.

According to the present invention, this central recess in head 16 and is defined by a flat, leather receiving, abutment wall 26 (seen in FIG. 2), and two opposed side walls **22*a* and 23*a*. A generally rectangular or trapezoidal central pad or panel 25, formed of resilient or yieldable leather, is installed in the central recess, the panel 25 abutting the back wall 26 and the side walls 22*a* and 23*a*. Glue or adhesive secures the panel 25 to wall 26 and secures the outer side edges of panel 25 to the opposed walls 22*a* and 23*a*. Hence, the leather panel 25 is snugly fixed within the recess defined by walls 22*a*, 23*a* and 26, so as to dispose the front or outer striking surface 25*a* of leather panel 25 in the common, generally vertical plane with face segments 22 and 23. The thickness of said panel is from approximately ¼ inch to about ¾ inch. The surface area of striking surface 25*a*** should be from about 25% to about 80% of the area of the entire face and preferably about 35% of the area.

The side walls **22*a* and 23*a* are each straight flat surfaces, in a common plane generally parallel to the plane of wall 26. Back wall 26 of the recess is vertically disposed, being parallel to and spaced inwardly from the common plane of face segments 22 and 23 and the striking surface 25*a* of panel 25**.

The central recess is approximately the shape and dimensions of the leather panel 25. Thus, the widths of the inner side walls **22*a* and 23*a* are approximately equal to the thickness of the central leather panel 25 and the glue or adhesive 27 which secures it in place. As seen in FIG. 3, walls 22*a* and 23*a*** taper upwardly, the outer wall 22*a* being inclined to a greater extent than inner wall 23*a*.

Panel 25 is preferably formed from shoe sole leather which is produced from processed, domestic, heavy steer hide. The conventional way in which the heavy steer hides are processed to produce shoe sole leather has been known for centuries and includes soaking the leather for about seven days in successively stronger aqueous solutions of lime and a small amount of sodium sulfide, so that these successively stronger solutions react with the hair follicles on the hyde and also plumbs the thickness of the hides to approximately twice their original thickness. The hides are then rubbed mechanically to remove the hair. Thereafter, the hides are delimed with carbonic acid ($CO_2$ gas in water). The hides are further processed by being tanned, using conventional tanning and washed. Thereafter, these hides are oiled and loading is added to the hides. The hides are next finished by rolling, stretching and drying.

A generally flat or slightly concaved sole plate 29 is secured in a conventional way, such as by screws, to the bottom surface 28. The sole plate 29 has a front surface 29*a* of which is inclined upwardly and outwardly so that the front upper edge of the sole plate 29 terminates at the lower front edges of face segments 22 and 23 and the striking surface 25*a* of panel 25. This reduces the likelihood that the front edge 29*a* will come in contact with the golf ball when the face of the head 15 engages the golf ball.

After installation of the leather panel 25 and the sole plate 29, the entire surface of club head 15, including the body 16, the exposed front striking surface 25*a*, the inner and outer face segments 22 and 23 and the surface of sole plate 29 are coated with one or several coats of plastic, namely polyurethane, so that a continuous layer 30 of polyurethane extends over the entire face of the putter head 15. This layer or surface is preferably 4 mils in the thickness, however, it can be up to about 9 mils in thickness and should be between about 2 mils and about 7 mils in thickness. In this thickness the polyurethane layer 30 over the leather panel 25 is yieldable and cooperates with the leather panel 25 to enable the player, using the club, to control the trajectory, roll and velocity of the golf ball.

The polyurethane liquid, which I recommend for use in producing the coating is known as "PP Poly-13" and has the following ingredients and characteristics:

| Ingredient | Percent By Weight |
|---|---|
| Resin NV Polyurethane | 39.21% |
| Xylol | 40.17% |
| Pryacetate (PMAC) | 3.74% |
| Ethy Benzene | 10.28% |
| Toluene Diisocynade (TDI) | .05% |
| Rebin NV Properties | .87% |
| Surfactant | .02% |
| Acetate | 5.64% |
| Boiling Point range | 281° F.-378° F. |
| Specific Density | 8.19 pounds/gal. |

The combination of the polyurethane layer 30 adhered over the outer striking surface 25*a* and the leather panel 25 is advantageous in that the film or layer 30 is flexible and yet has a hardness in the general range of the hardness of surface of a golf ball. The layer 30 is sufficiently flexible, so as to be deformed inwardly as the golf ball is struck. The leather panel 25, however, forms a firm, yieldable, non-rigid substrate for the layer 30 throughout the central portion of the face and by yielding slightly as the ball is struck, enables a portion of the ball, which is being engaged by the club to be uniformly encompassed over this engaged peripheral portion of the ball for applying force to the ball over a small tangential area of the ball to more accurately direct the ball in the prescribed direction toward the hole of the green. Polyurethane is relatively slick, so it has a tendency to permit the ball to begin its rotation while being engaged by the surface of the polyurethane layer 30. Thus, the leather panel 25 acts very much like the leather tip of a pool cue in directing the golf ball quite accurately toward the hole. The net effect is to enable the player doing the putting, with practice, to control the course and distance of travel of the ball.

It will be obvious to those skilled in the art that many variations may be made in the present invention, without departing from the scope of the claims, as defined by the appended claims.

I claim:

1. A golf club of the type having:
(a) a shaft;
(b) a head having a heel portion, a toe portion and a face;
(c) a neck on said head having a hosel therein fixedly receiving an end portion of said shaft;
(d) a resilient panel in said head for forming a substantial portion of said face and for providing a striking surface for engaging a golf ball when said club is used;
(e) said panel being composed of shoe sole leather;
(f) said panel having an outer surface and including a polyurethane layer adhered to said outer surface of said panel; and
(g) said polyurethane layer having a thickness of between 2 mils and 9 mils.

2. A golf club of the type having:
(a) a shaft;
(b) a head having a heel portion, a toe portion and a face;
(c) a neck on said head having a hosel therein fixedly receiving an end portion of said shaft;
(d) a resilient panel in said head for forming a substantial portion of said face and for providing a striking surface for engaging a golf ball when said club is used; and
(e) a layer of polyurethane over said panel, said layer having a thickness of from about 2 mils and about 9 mils.

3. A golf club of the type having a shaft and a head on the end of said shaft, said head being provided with a heel portion, a toe portion, and a face, the improvement comprising:

said head including a pair of spaced face segments and a recess with a back surface between said face segments, said face segments having outer surfaces in a common plane and opposed edges defining said recess, a panel disposed in said recess and between said face segments, said panel having opposed edges contiguous with said edges of said segments, said panel being composed of shoe sole leather and being disposed in said recess between said face segments and against said back surface, said panel having an outer surface in a common plane with the outer surfaces of said face segments, and a plastic film disposed over, adhered to and covering the outer surface of said panel and the outer surfaces of said face segments so as to form a continuous layer along the surfaces of said face segments and the outer surface of said panel; said plastic film and said leather panel being simultaneously yieldable when receiving the impact of a golf ball thereon.

4. The golf club defined in claim 3 wherein said plastic film has a thickness of between about 2 microns and 9 microns.

5. The golf club defined in claim 3 including adhesive material adhering the rear surfaces of said panel to the back surface of said recess and the side surfaces of said panel to said side surfaces of said segments.

6. The golf club defined in claim 3 wherein said film is polyurethane.

7. The golf club defined in claim 3 wherein the thickness of said shoe sole leather panel is between about 1/16 inch and ¾ inch.

* * * * *